US005528840A

United States Patent [19]

Pajak et al.

[11] Patent Number: 5,528,840

[45] Date of Patent: Jun. 25, 1996

[54] PORTABLE FOOTWEAR AND SMALL APPAREL DRYING APPARATUS

[75] Inventors: Kenneth J. Pajak, 2 Richmond Hill, Laguna Niguel, Calif. 92677; Douglas S. Pajak, 5573 Tamres Dr., San Diego, Calif. 92111; Gregg L. Miron, San Diego, Calif.

[73] Assignees: Kenneth J. Pajak, Stamford, Conn.; Douglas S. Pajak, San Diego, Calif.

[21] Appl. No.: 262,778

[22] Filed: Jun. 20, 1994

[51] Int. Cl.[6] ..... F26B 9/00

[52] U.S. Cl. ..... 34/622; 34/202; 34/233; 34/235

[58] Field of Search ..... 34/618, 619, 621, 34/622, 202, 218, 233, 235

[56] References Cited

U.S. PATENT DOCUMENTS

| | | | |
|---|---|---|---|
| 2,701,921 | 2/1955 | Strongson | 34/622 |
| 2,975,529 | 3/1961 | Weber | 34/622 |
| 3,409,996 | 11/1968 | Konstandt | 34/622 |
| 3,905,125 | 9/1975 | Hubner | 34/622 |
| 4,873,773 | 10/1989 | Canonge | 34/622 |
| 5,323,897 | 6/1994 | Sperber | 34/622 |

FOREIGN PATENT DOCUMENTS

| | | | |
|---|---|---|---|
| 1238937 | 7/1960 | France | 34/622 |

*Primary Examiner*—Henry A. Bennett
*Assistant Examiner*—Susanne C. Tinker
*Attorney, Agent, or Firm*—Presseisen & Reidelbach

[57] ABSTRACT

The present invention provides a lightweight, portable drying apparatus which naturally, uniformly and quickly drys footwear and small items of apparel such as shoes, hats, gloves and scarves. The portable drying apparatus includes a flexible waterproof bag having an inner support structure for holding multiple pieces of footwear and small articles of apparel. The flexible bag may be rigidly supported by a top panel and a collapsible waterproof tri-fold support insert which defines the boundaries of an enclosed inner chamber. During operation, ambient air is circulated throughout the chamber using a blower assembly mounted on the support structure for drawing air into the chamber, and a vent formed in the flexible bag material for releasing the drawn air from the chamber. In a second embodiment, the support structure includes a base panel for defining a bottom portion of the chamber and two or more removable flexible rods bent in an arch shape to form a dome shaped structure. In a third embodiment, the support structure includes three or more removable rods extending from a base support in a slanted upward direction to form a tepee structure.

12 Claims, 3 Drawing Sheets

PORTABLE FOOTWEAR AND SMALL APPAREL DRYING APPARATUS

BACKGROUND OF THE INVENTION

1. Field of the Invention

The present invention relates generally to devices for drying outerwear, and more particularly to a lightweight, portable drying apparatus which naturally, uniformly and quickly drys footwear and small items of apparel such as shoes, hats, gloves and scarves after they have been wetted.

2. Description of the Related Art

There are a variety of drying devices which have been developed over the years to decrease the drying times of footwear and small items of apparel. A sample of three different types of drying devices and their respective limitations are described below.

U.S. Pat. No. 5,003,707, entitled "Portable Boot Drying Apparatus," issuing to Chu, discloses the use of an apparatus for supplying a flow of heated air to the interior cavity of a pair of ski boots. While this device lends itself to portability due to its small size, there are several problems with using such a device for drying footwear. One problem is that the device is limited to boots and can only dry one pair at a time. Another problem is that heated air regularly applied to footwear made of material such as leather and/or plastic compromises the material of the item, causing it to harden, crack or fade in color. Consequently, the life of the footwear is shortened every time it is dried using this device.

It is well known in the art of drying that articles of apparel, such as leather, naturally dry from the outside inward. Consequently, by directing a concentrated flow of air into only the inner areas of the footwear, such as an inner shoe cavity, the item dries unnaturally and unevenly from the inside outward leaving unattractive water spots on the outside material of the apparel, or leaving the outside entirely damp.

Finally, this invention requires attaching an external hair dryer to the body of the device, and mounting the hair dryer in close proximity to the wet articles. Such a configuration presents the serious safety hazard of electrocution making it particularly unattractive for situations where children might be the ultimate user of the device.

U.S. Pat. No. 5,165,181, entitled "Shoe Dryer," issuing to Acosta, Sr. et al., discloses the use of a drying compartment which utilizes the exhaust heat from a conventional clothes dryer to dry shoes. As discussed above, the use of heated air to dry footwear and small items of apparel severely limits the life of the item and therefore the appeal of using such a device. Furthermore, the use of this device is quite limited in that it must be used in conjunction with a conventional clothes dryer. Consequently, this device is not portable to remote locations and may be limited to adult use.

U.S. Pat. No. 5,199,188, entitled "Method and Apparatus for Drying Footwear and Handwear," issuing to Franz, discloses the use of a blower assembly and central tube extending up from the blower assembly for directing air into a tree-rack for contact with the wet or damp apparel. This device utilizes either heated or ambient air to dry the footwear or handwear. The problem with this device is threefold. First, this device drys footwear and small items of apparel unevenly and unnaturally from the inside outward as described above. Second, the device is heavy, bulky and cumbersome making both storage and portability difficult. Finally, mounting the footwear or handwear on the open tree-rack for drying creates a messy unattractive environment if the footwear and small items of apparel are dirty or muddy. Because the apparatus is not self contained, excess water and/or mud will flow down the tree-rack onto the base of the blower assembly and floor creating an unattractive environment, and possibly a severe safety hazard.

SUMMARY OF THE INVENTION

The purpose of the present invention is to provide a drying apparatus which quickly drys multiple pieces of footwear and small items of apparel naturally and uniformly from the outside of the article inward while avoiding damage to the materials of the articles caused by conventional drying methods. It is another purpose of the present invention to provide a drying apparatus having a collapsible lightweight construction for portability to remote locations, as well as easy storage. It is yet another purpose of the present invention to provide a self contained drying apparatus which may serve the dual purpose of apparel dryer and travel compartment, and which is easy to clean, safe to use, and maintains an attractive appearance.

In a preferred embodiment, the portable drying apparatus includes a flexible bag for holding various footwear and small articles of apparel such as shoes, hats, gloves and scarves. The flexible bag is fabricated from a lightweight waterproof material which is rigidly supported to establish the boundaries of an enclosed inner chamber.

During operation, ambient air is circulated throughout the chamber by using a fan mounted on the rigid support structure for drawing air into the chamber and a vent formed in the flexible bag material for releasing the drawn air from the chamber. The position of the fan with respect to the vent is designed to maximize the drying capabilities of the present invention. The vent may be a mesh patterned strip selectively formed in the flexible bag, or in the alternative, a number of preselected holes formed around the periphery of the bag.

The supporting apparatus may be embodied in several mechanical structures. For example, in one embodiment, a series of collapsible panels are positioned inside the flexible bag for establishing the respective boundaries of the chamber. More specifically, a top panel is attached to the flexible bag for defining the top portion of the chamber. The fan for drawing air into the chamber is mounted on the top panel. A bottom panel is loosely positioned in the bag for defining a bottom portion of the chamber. The top panel and the bottom panel are distanced from each other by the force of gravity or by a distance maintaining structure.

One type of distance maintaining structure includes two or more orthogonal side panels to form a substantially rectangular shaped chamber. For example, an orthogonal first side panel is positioned in the bag between the top panel and the bottom panel for defining a first side wall of the chamber, and an orthogonal second side panel is positioned in the bag between the top panel and the bottom panel for defining a second side wall of the chamber. If desired, the bottom panel, first side panel, and second side panel can be movably connected to form a tri-fold insert. The tri-fold insert is collapsible and removable for easy cleaning and storage, and may be surrounded by a waterproof material. The front portion and the back wall of the chamber are formed only by the fabric comprising the flexible bag.

Another type of distance maintaining structure includes a number of removable support rods positioned at various locations in the bag between the top panel and the bottom panel. For example, a rod may be placed at each respective corner of the chamber. Accordingly, the first side wall, second side wall, front portion, and back wall are all formed by the fabric comprising the bag which surrounds the chamber.

The front portion of the chamber may be selectively attached to the flexible bag for providing access to the footwear and articles of apparel. For example, the front portion may be designed as a front flap to form a door for accessing the items. The vent may be formed in the back wall of the chamber toward the bottom portion of the bag.

In a second embodiment, the supporting apparatus includes a bottom base panel positioned in the bag for defining a bottom portion of the chamber. Two or more removable flexible rods are bent in an arch shape and positioned inside the chamber to form a dome shaped structure. The fan is braced between two of the flexible rods near the top of the dome shaped structure.

In a third embodiment, three or more removable rods may be placed on the base support in a slanted upward position to form a tepee shaped structure. The fan may be supported by the respective ends of the rods at the top of the tepee structure.

These and other features and advantages of the invention will be apparent to those skilled in the art from the following detailed description, taken together with the accompanying drawings, in which:

DETAILED DESCRIPTION OF THE INVENTION

Figure 1:
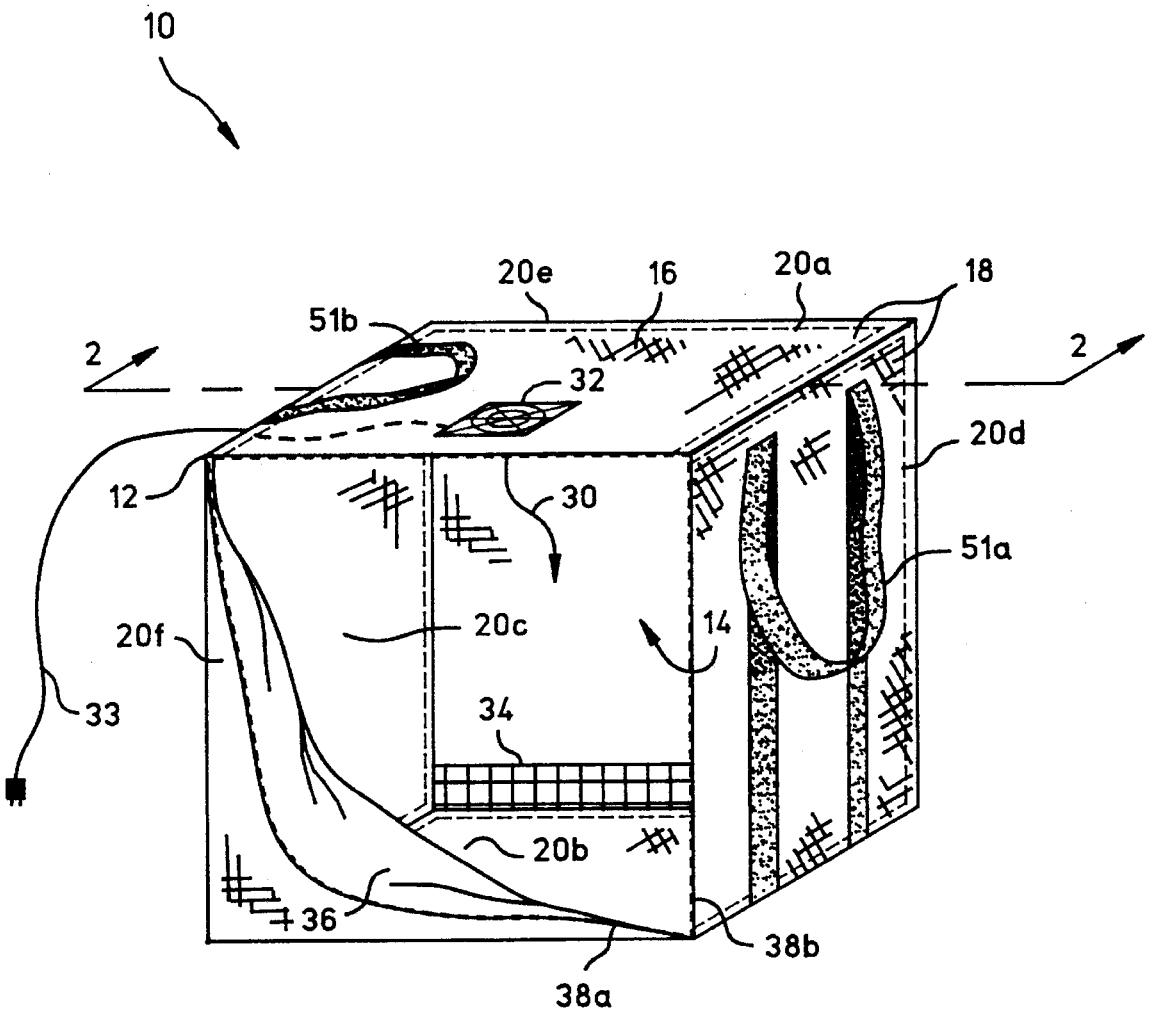
FIG. 1 is a perspective view of the preferred embodiment in a fully extended configuration.

As illustrated in FIG. 1, an apparel drying apparatus 10 embodying the present invention includes a housing 12 having an enclosed inner chamber 14 for holding footwear and small articles of apparel such as shoes, hats, gloves and scarves. The housing 12 of the apparatus 10 includes an outer flexible bag 16 and an inner support structure 18. The outer flexible bag 16 may be fabricated from a lightweight waterproof material. Preferably, the outer flexible bag 16 is fabricated by bonding an outer polyester fabric material with an inner waterproof material such as nylon, vinyl, or polyvinyl chloride. However, other material not herein mentioned may be used.

In the preferred embodiment, the inner support structure 18 includes multiple panels 20*a–d* positioned inside the flexible bag 16 for defining the respective boundaries of the chamber 14. The panels 20*a–d*, shown more clearly in FIG. 2, may be made of any type of rigid support material, such as wood, plastic, or styrofoam. Although the panels 20*a–d* may be custom designed to meet the specific needs of the user, the panels 20*a–d* are preferably made of a thin press board material having height and width dimensions of between 14 inches and 16 inches.

Figure 2:
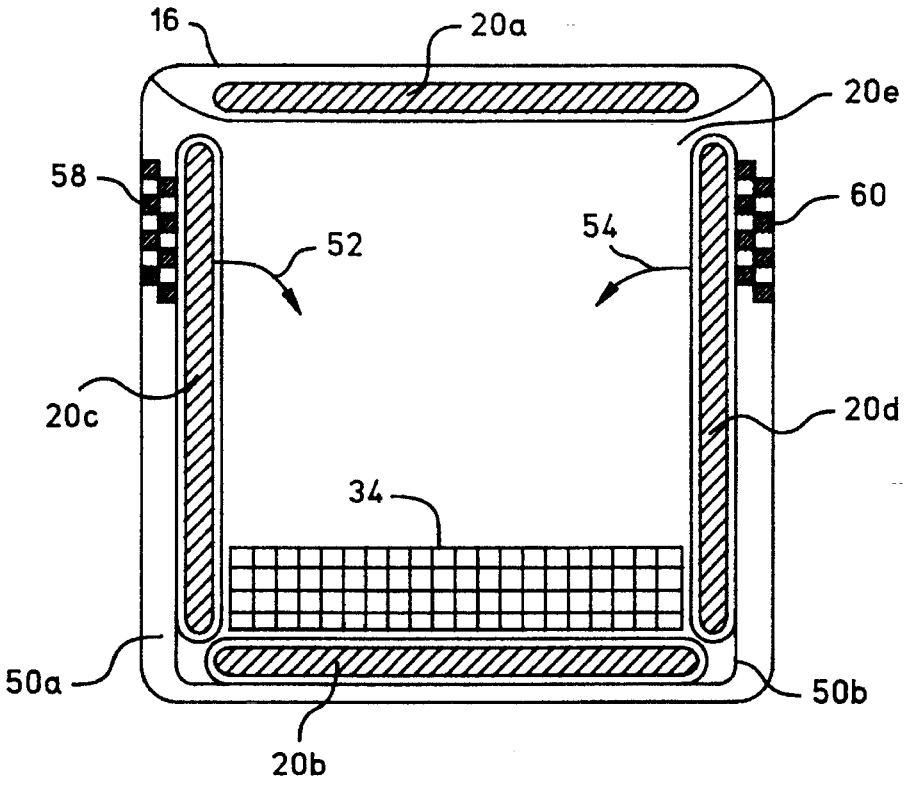
FIG. 2 is a cross sectional view taken at lines 2—2 of FIG. 1 illustrating the rigid support means within the flexible bag.

A top panel 20*a*, shown in dotted lines in FIG. 1, is attached to the flexible bag 16 for defining a top portion of the chamber 14. The top panel 20*a* may be permanently sewn into the outer flexible bag 16, as shown in FIG. 2, or attached to the flexible bag 16 by any means well known in the art such a Velcro or mechanical fasteners. A bottom panel 20*b* is loosely positioned in the flexible bag 16 substantially parallel to the top panel 20*a* for defining a bottom portion of the chamber 14. As illustrated in FIG. 2, bottom panel 20*b*, first side panel 20*c* and second side panel 20*d* may each be surrounded by a lightweight waterproof material such as that used to form the flexible bag. If desired, the panel 20*b*, 20*c* and 20*d* may also be held in place by some type of attachment device such as Velcro, mechanical fasteners, or other means known in the art.

The top panel 20*a* and bottom panel 20*b* are distanced from each other to establish the boundaries of the enclosed inner chamber 14. This may be accomplished by simply hanging the apparel drying apparatus 10 above ground level from a handle (not shown) attached to the top of the flexible bag 16, thus allowing the force of gravity to automatically establish the chamber 14. Alternatively, a removable distance maintaining structure may be used to provide a mechanical means of creating the inner boundaries of the chamber 14. For example, panels 20*c, d* may be used to distance the bottom panel 20*b* from the top panel 20*a*. A first side panel 20*c* is positioned in the flexible bag 16 between the top panel 20*a* and the bottom panel 20*b* for defining a first side wall of the chamber 14. Similarly, a second side panel 20*d*, shown in dotted lines in FIG. 1, is positioned opposite and substantially parallel to the first side panel 20*c* for defining a second side wall of the chamber 14. Preferably, the first side panel 20*c* and the second side panel 20*d* are oriented orthogonally to the top panel 20*a* and the bottom panel 20*b*, thereby forming a substantially rectangular or cubed shaped structure. Supported as such, the back wall 20*e* and front portion 20*f* are formed only by the material of the outer flexible bag 16.

Another type of distance maintaining structure includes multiple removable support rods (not shown) positioned at various locations in the flexible bag 16 between the top panel 20*a* and the bottom panel 20*b*. The support rods, made from any rigid support material such as hard plastic or metal, may be placed in the inside chamber area 14 of the flexible bag 16, such as the respective corners of the chamber 14. The rods may be held in place by support pockets (not shown) sewn into the flexible bag 16, or by any other means well known in the art. If such a distance maintaining structure is used, the first side wall 20*c*, second side wall 20*d*, back wall 20*e* and front portion 20*f* exist only of the material comprising the flexible bag 16.

During operation of the present invention, air 30 is circulated throughout the chamber 14, in and around the footwear and articles of apparel located within the chamber 14. This is accomplished using a blower assembly 32 for drawing air 30 into the chamber 14, and a vent 34 for releasing the drawn air 30 from the chamber 14.

The blower assembly 32 is a fan mounted on the top panel 20*a* for drawing ambient air into the chamber 14. Although the blower assembly 32 is preferably a fan, the present invention contemplates the use of a heater which serves as both a fan and a heater for circulating warm or hot air within the chamber 14.

For decreased drying times and uniform drying results, the fan can be mounted toward the front portion 20*f* of the housing 12 as shown in FIG. 1. Mounted in this way, shoes and boots may be easily positioned in the chamber 14 to provide a more direct flow of air from the blower assembly 32 to the inner cavity of the shoes or boots. Accordingly, air is circulated around the outer periphery of the footwear as well as throughout the inner cavity of the footwear, resulting in decreased drying times and increased drying uniformity. It is to be understood however, that the present invention contemplates the placement of the blower assembly 32 in other locations on the top panel 20*a*.

The blower assembly 32 has a power cord 33 extending from the blower assembly 32 which may be plugged into any standard wall outlet or may be used in conjunction with a dc adapter (not shown) for use with a portable battery in remote locations.

An optional air directing device (not shown), may be attached to the blower assembly 32 for directing the drawn air 30 into preselected areas within the chamber 14. The air directing device has an expandable lip portion for easy attachment to the blower assembly 32. Multiple flexible air flow tubes extend from the lip portion of the air directing device to provide a concentrated flow of air to desired areas within the chamber 14.

The size of the vent 34 with respect to the size of the chamber 14, and the location of the vent 34 with respect to the blower assembly 32, is designed for maximum air circulation to minimize drying times. The vent 34 may be a solid strip formed near the bottom of the chamber 14 as shown in FIG. 1 and FIG. 2, or alternatively a number of preselected holes (not shown) formed around the periphery of the flexible bag 16. Based upon experimentation, best results were accomplished using a vent 34 made of a mesh patterned strip formed in the back wall 20*e* across the bottom of the chamber 14. For example, a pair of mens dress shoes soaked in water for five minutes were dried in approximately twenty-five minutes using this vent configuration. Typically, it would take approximately eight hours for the shoes to dry if left in an open room environment.

Referring to FIG. 1, the front portion 20*f* of the housing 12 may be selectively attached to provide access to the articles of apparel within the chamber 14. For example, a front flap 36 may be designed in the front portion 20*f* of the flexible bag 16 to form a door for accessing the footwear and articles of apparel. Selective attachment of the front portion 20*f* may be accomplished by a zipper device 38*a, b*, attached to the front flap 36 and flexible bag 16 respectively, or any by any other known means of attachment such as Velcro or button fasteners.

For use as a travel bag or ease of portability, handles 51*a, b* may be attached to the flexible bag 16. Preferably, each handle 51*a, b* is made of a sturdy material and sewn directly into the respective sides of the flexible bag 16.

Figure 3:
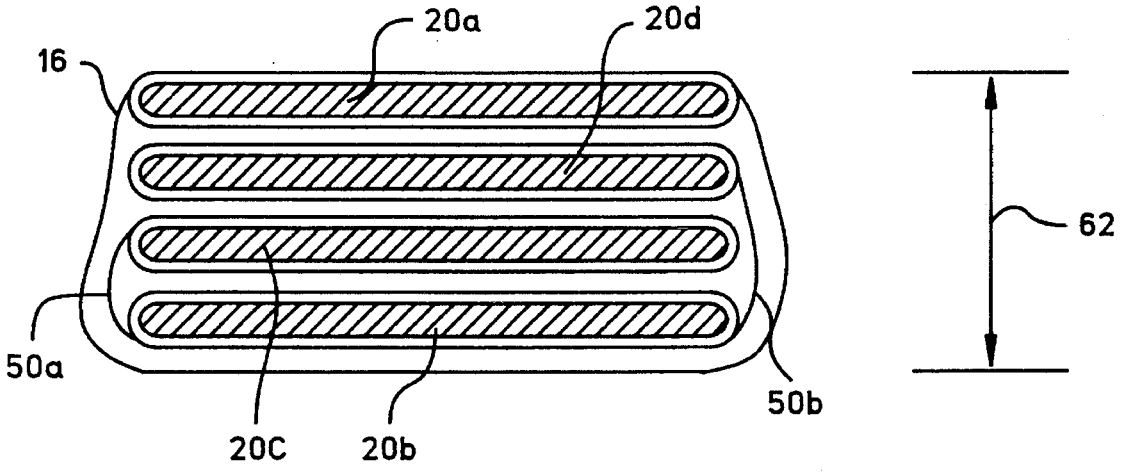
FIG. 3 is a cross sectional view of the preferred embodiment as illustrated in FIG. 2 but in a fully collapsible configuration.

To decrease the size of the footwear and small apparel drying apparatus 10 for easy storage and increased portability, certain portions of the inner support structure 18 of housing 12 are designed to be collapsible. As shown in the fully extended cross sectional view of FIG. 2, the bottom panel 20*b*, first side panel 20*c*, and second side panel 20*d* are movably connected at folds 50*a*, b to form a tri-fold support structure. Folds 50*a*, b may be fabricated from the same waterproof material comprising the bag and surrounding the panels 20*b, c, d*. The first side panel 20*c* may fold in a downward direction 52 toward bottom panel 20*b*. Similarly, the second side panel 20*d* may fold in a downward direction 54 over the first side panel 20*c* and toward the bottom panel 20*b*. FIG. 3 shows a cross sectional view of the present invention in a fully collapsible configuration having a height 62 of between 1.00 and 2.00 inches. Preferably, the flexible bag 16 is collapsible to a height of approximately 1.75 inches.

The tri-fold support structure is held in place in its fully extended position by attachments 58 and 60 as shown in FIG. 2. Preferably, attachments 58 and 60 are formed of male and female Velcro strips located of the inner surface of the flexible bag 16 and the support panels 20*c, d* respectively. Using such a simple construction, the tri-fold support insert is removable from the outer flexible bag 16 for easy cleaning capabilities, and is simpily and easily erected by both adults and children.

Figure 4:
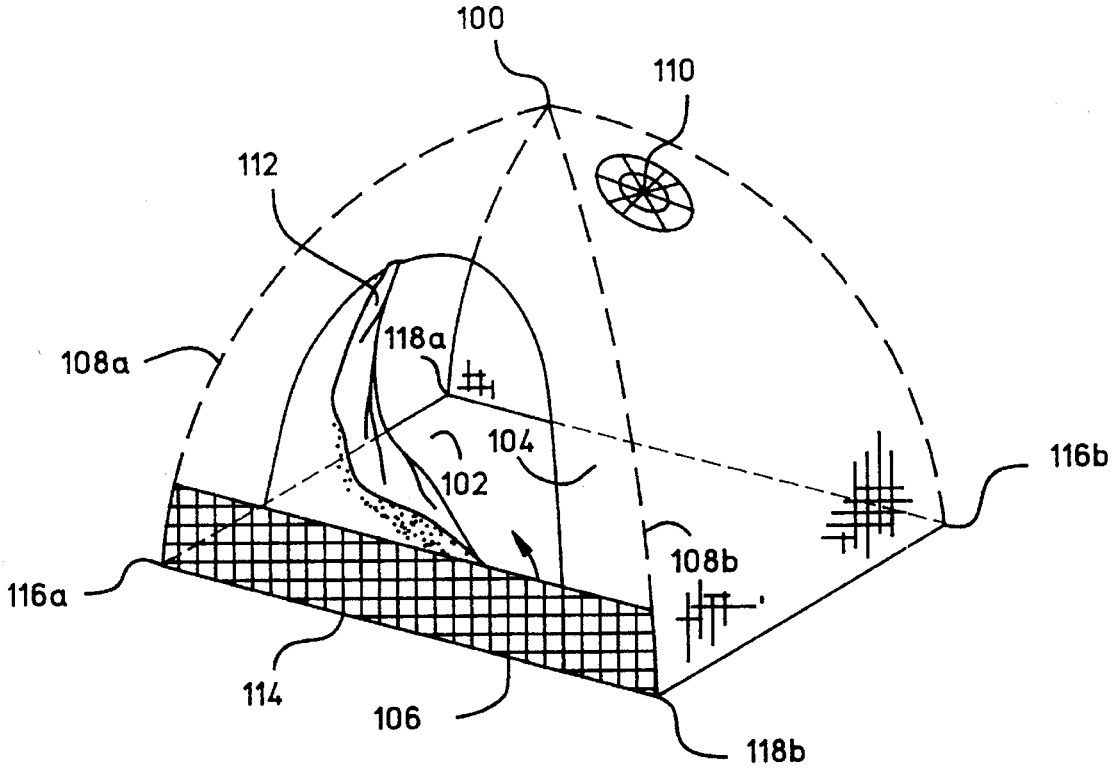
FIG. 4 is second embodiment of the present invention illustrating a rigid support means which forms a dome shaped structure.

In a second embodiment of the present invention, as shown in FIG. 4, the rigid supporting structure 100 includes a bottom base panel 102 positioned in the flexible bag 104 for defining a bottom portion of the chamber 106. The bottom base panel 102 may be maintained in place by any means well known in the art such as Velcro or mechanical fasteners. Two or more removable flexible rods 108*a, b*, shown as dotted lines in FIG. 4, are bent in an arch shape and positioned inside the chamber 106 to form a dome shaped structure. More specifically, rods 108*a, b* have a first end 116*a*, 118*a*, and a second end 116*b*, 118*b*, both ends of each rod positioned at predetermined locations on the bottom base support panel 102.

A blower assembly 110 is mounted on and braced between rods 108*a, b* near the top of the dome shaped structure. Additionally, a vent 114 is formed across the bottom of the flexible bag 104. As in the preferred embodiment, a front flap 112 is formed in the flexible bag 104 to provide access to the articles of apparel located within chamber 106.

Figure 5:
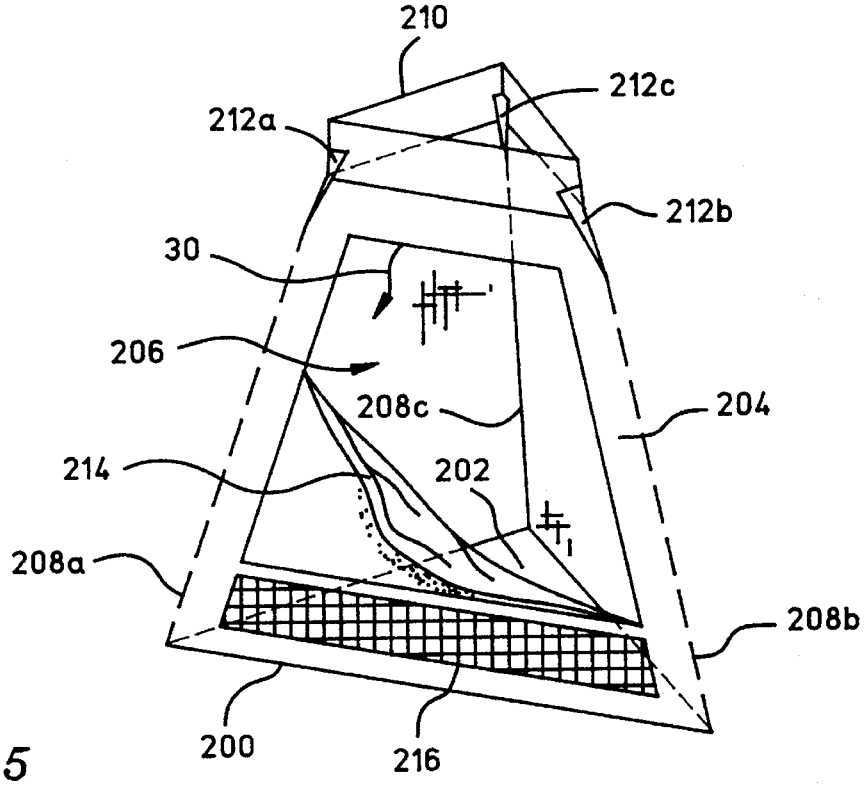
FIG. 5 is a third embodiment of the present invention illustrating a rigid support means which forms a tepee shaped structure.

In a third embodiment of the present invention, as shown in FIG. 5, the supporting structure 200 includes a circular bottom base panel 202 positioned in the flexible bag 204 for defining a bottom portion of the chamber 206. The bottom base panel 202 may be maintained in place by any means well known in the art such as Velcro or mechanical fasteners. Three or more removable rods 208*a–c* are placed against the inner wall of the flexible bag 204 in a slanted upward position to form a tepee shaped structure. A blower assembly 210 having rod supports 212*a–c* formed thereon, is supported by the respective ends of rods 208*a–c* at the top of the tepee structure. A vent 216 is formed across the bottom of the flexible bag 204. As in the preferred embodiment, a front flap 214 is formed in the flexible bag 204 to provide access to the footwear and articles of apparel within chamber 206.

While preferred embodiments of the invention have been shown and described, numerous variations and alternate embodiments will be apparent to those skilled in the art. Accordingly, it is intended that the invention be limited only in terms of the appended claims.

We claim:

1. A self-supporting apparatus for drying footwear and small articles of apparel, comprising:

a flexible bag for holding said articles of apparel;

means for self-supporting said flexible bag to establish an enclosed inner chamber, said self-support means including a top panel attached to said bag for defining a top surface of said chamber, a bottom panel positioned in said bag substantially parallel to said top panel for defining a bottom surface of said chamber, an orthogonal first side panel positioned in said bag between said top panel and said bottom panel for defining a first side wall of said chamber, and an orthogonal second side panel positioned in said bag between said top panel and said bottom panel for defining a second side wall of said chamber;

means for drawing air into said chamber, said drawing means mounted on said self-support means;

a vent formed in said bag for releasing said drawn air from said chamber; and means for accessing the inside of said chamber.

2. An apparatus as recited in claim 1, wherein said air drawing means is a fan, and said fan is mounted on said top panel of said self-support means.

3. An apparatus as recited in claim 1, wherein said first side panel is positioned opposite and substantially parallel to said second side panel whereby said chamber defined by said support means forms a substantially rectangular shaped structure.

4. An apparatus as recited in claim 3, wherein said first side panel is movably attached to said bottom panel, said bottom panel is movably attached to said second side panel, wherein said first side panel, said bottom panel, and said second side panel form a tri-fold insert, said tri-fold insert being removable from said bag.

5. An apparatus as recited in claim 1, wherein said vent comprises a plurality of preselected holes formed in said bag.

6. An apparatus as recited in claim 1, wherein said vent comprises a mesh patterned strip selectively formed in said bag.

7. An apparatus as recited in claim 1, further comprising an air directing device attached to said fan inside said chamber for directing said drawn air into preselected areas of said chamber.

8. An apparatus as recited in claim 1, wherein said bag is fabricated from a flexible waterproof material.

9. An apparatus as recited in claim 6, wherein said vent is a mesh patterned strip having a height of between 1 and 3 inches.

10. An apparatus as recited in claim 1, wherein said accessing means is a front flap formed in said flexible bag.

11. A self-supporting apparatus for drying footwear and small articles of apparel, comprising:

a flexible bag for holding said articles of apparel;

a bottom base support positioned in said bag;

a plurality of flexible rods having a first end and a second end, said first end and said second end of each said rod positioned at predetermined locations on said base support in said bag thereby forming a self-supporting dome shaped structure;

means for drawing air into said bag;

a vent formed in said bag for releasing said drawn air from said chamber; and means for accessing the inside of said chamber.

12. An apparatus for drying footwear and small articles of apparel, comprising:

a flexible bag for holding said articles of apparel;

means for rigidly supporting said flexible bag to establish an enclosed inner chamber, said rigid support means including a top panel attached to said bag for defining a top surface of said chamber, a bottom panel positioned in said bag substantially parallel to said top panel for defining a bottom surface of said chamber, an orthogonal first side panel positioned in said bag between said top panel and said bottom panel for defining a first side wall of said chamber, an orthogonal second side panel positioned opposite and substantially parallel to said first side panel for defining a second side wall of said chamber, and wherein said first side panel is movably attached to said bottom panel, said bottom panel is movably attached to said second side panel, and wherein said first side panel, said bottom panel, and said second side panel form a tri-fold insert, said tri-fold insert being removable from said bag;

means for drawing air into said chamber, said drawing means mounted on said rigid support means;

a vent formed in said bag for releasing said drawn air from said chamber; and means for accessing the inside of said chamber.

* * * * *